US008100641B2

(12) United States Patent
Bracken

(10) Patent No.: US 8,100,641 B2
(45) Date of Patent: Jan. 24, 2012

(54) STEAM TURBINE HAVING STAGE WITH BUCKETS OF DIFFERENT MATERIALS

(75) Inventor: Robert James Bracken, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 805 days.

(21) Appl. No.: 12/206,852

(22) Filed: Sep. 9, 2008

(65) Prior Publication Data

US 2010/0061857 A1 Mar. 11, 2010

(51) Int. Cl.
*F04D 29/54* (2006.01)

(52) U.S. Cl. ..... 415/200; 416/241 R

(58) Field of Classification Search ..... 415/12, 415/193, 195, 194; 41/194; 416/201 R
See application file for complete search history.

(56) References Cited

U.S. PATENT DOCUMENTS 5,474,421 A 12/1995 Rossmann
7,048,507 B2 * 5/2006 Wettstein et al. ..... 416/203
7,147,437 B2 * 12/2006 Burdgick et al. ..... 416/1
2002/0064458 A1 5/2002 Montgomery et al.
2004/0208741 A1 10/2004 Barb
2006/0073019 A1 4/2006 Wettstein et al.

FOREIGN PATENT DOCUMENTS

EP 0761931 A1 3/1997
EP 1626161 A1 2/2006
EP 1830037 A2 9/2007
JP 59150903 A 8/1984
JP 2006144575 A 6/2006

OTHER PUBLICATIONS

EP International Search Report With Written Opinion, Sep. 25, 2009, 6 pages.

* cited by examiner

*Primary Examiner* — Stephen W Smoot
(74) *Attorney, Agent, or Firm* — Hoffman Warnick LLC

(57) ABSTRACT

A steam turbine having a stage including buckets of different material. For example, a set of first buckets may be made of a first material and a set of second buckets may be made of a second material, where the first material is different than the second material.

10 Claims, 3 Drawing Sheets

STEAM TURBINE HAVING STAGE WITH BUCKETS OF DIFFERENT MATERIALS

BACKGROUND OF THE INVENTION

The invention relates generally to steam turbines. More particularly, the invention relates to a steam turbine stage with integral covered buckets of different materials.

The steam flow path of a steam turbine is generally formed by a stationary casing and a rotor. In this configuration, a number of stationary vanes are attached to the casing in a circumferential array and extend inward into the steam flow path. Similarly, a number of rotating buckets are attached to a rotating shaft of the rotor in a circumferential array and extend outward into the steam flow path. The stationary vanes and rotating buckets are arranged in alternating rows so that a row of vanes and the immediately downstream row of buckets form a stage. The vanes serve to direct the flow of steam such that it enters the downstream row of buckets at the correct angle. Airfoils of the buckets extract energy from the steam, thereby developing the power necessary to drive the rotor and the load attached thereto.

As the steam flows through the steam turbine, its pressure drops through each succeeding stage until the desired discharge pressure is achieved. Thus, steam properties such as temperature, pressure, velocity and moisture content vary from row to row as the steam expands through the flow path. Consequently, each bucket row employs buckets having an airfoil shape that is shaped for the steam conditions associated with that row. In addition to airfoil shape, the buckets terminate in integral covers that are sized and positioned to maintain contact with the cover of an adjacent bucket in a row when assembled and during use. There are two reasons for this structure. First, the continually contacting covers increase steam path performance by reducing and/or eliminating gaps between adjacent buckets and the cover and vane interface. Second, buckets that do not have continual cover contact with adjacent buckets become 'freestanding', which leads to failure. Maintaining continual cover contact is a design challenge for applications in excess of, for example, about 975° F. due to the onset of long-term creep of the vane and/or rotor interface. Current approaches use advanced materials, such as a nickel-based alloys for integral covered buckets or stainless steel alloy buckets with peened (i.e., separated) covers in regions of the steam turbine where creep is a limiting factor.

BRIEF DESCRIPTION OF THE INVENTION

A first aspect of the disclosure provides a steam turbine comprising: a stage including a plurality of buckets, the plurality of buckets including a set of first buckets made of a first material and a set of second buckets made of a second material, the first material different than the second material.

A second aspect of the disclosure provides a stage of a plurality of buckets for a steam turbine, the stage comprising: a set of first buckets made of a first material and a set of second buckets made of a second material, the first material different than that second material.

DETAILED DESCRIPTION OF THE INVENTION

At least one embodiment of the present invention is described below in reference to its application in connection with and operation of a steam turbine. However, it should be apparent to those skilled in the art and guided by the teachings herein that the present invention is likewise applicable to any suitable turbine and/or engine. Embodiments of the present invention provide a steam turbine having a stage that has buckets of different material.

Figure 1:
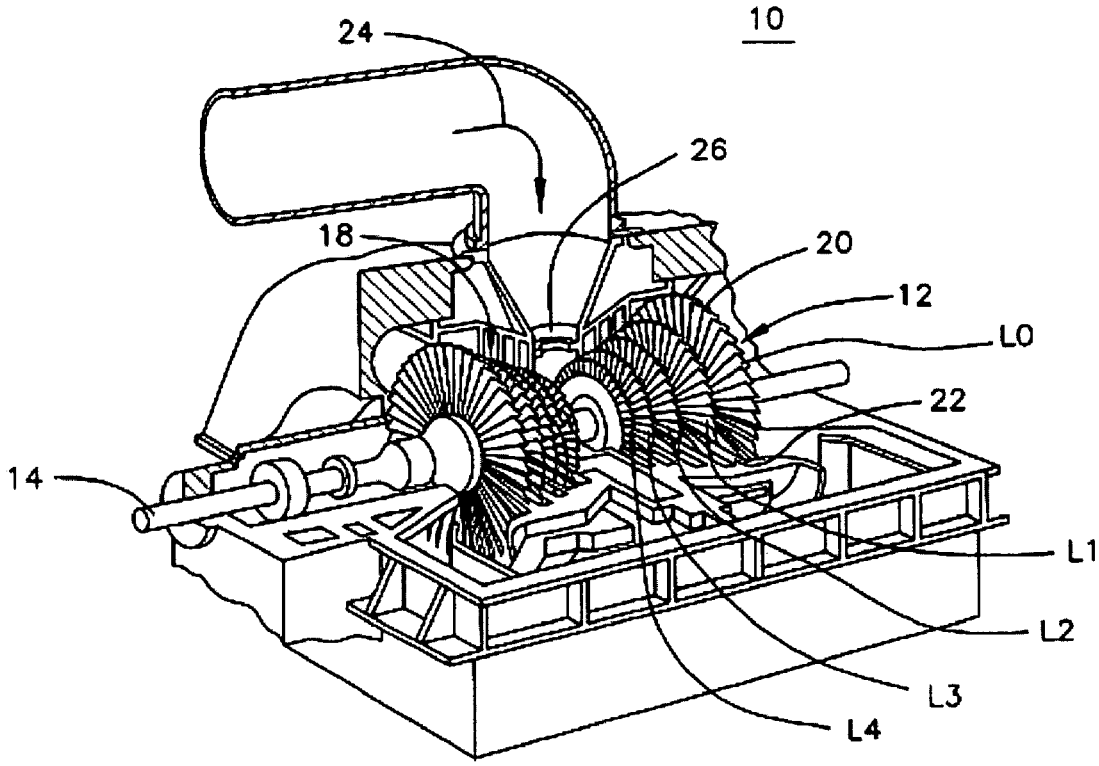
FIG. 1 is a perspective partial cut-away illustration of a steam turbine

Referring to the drawings, FIG. 1 shows a perspective partial cut-away illustration of a steam turbine 10. The steam turbine 10 includes a rotor 12 that includes a rotating shaft 14 and a plurality of axially spaced rotor wheels 18. A plurality of rotating buckets 20 are mechanically coupled to each rotor wheel 18. More specifically, buckets 20 are arranged in rows that extend circumferentially around each rotor wheel 18. A plurality of stationary vanes 22 extends circumferentially around shaft 14 and are axially positioned between adjacent rows of buckets 20. Stationary vanes 22 cooperate with buckets 20 to form a stage and to define a portion of a steam flow path through turbine 10.

In operation, steam 24 enters an inlet 26 of turbine 10 and is channeled through stationary vanes 22. Vanes 22 direct steam 24 downstream against buckets 20. Steam 24 passes through the remaining stages imparting a force on buckets 20 causing shaft 14 to rotate. At least one end of turbine 10 may extend axially away from rotor 12 and may be attached to a load or machinery (not shown) such as, but not limited to, a generator, and/or another turbine.

In one embodiment of the present invention as shown in FIG. 1, turbine 10 comprises five stages. The five stages are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). It is to be understood that five stages are shown as one example only, and a turbine may have more or less than five stages. Also, as will be described herein, the teachings of the invention do not require a multiple stage turbine.

Figure 2:
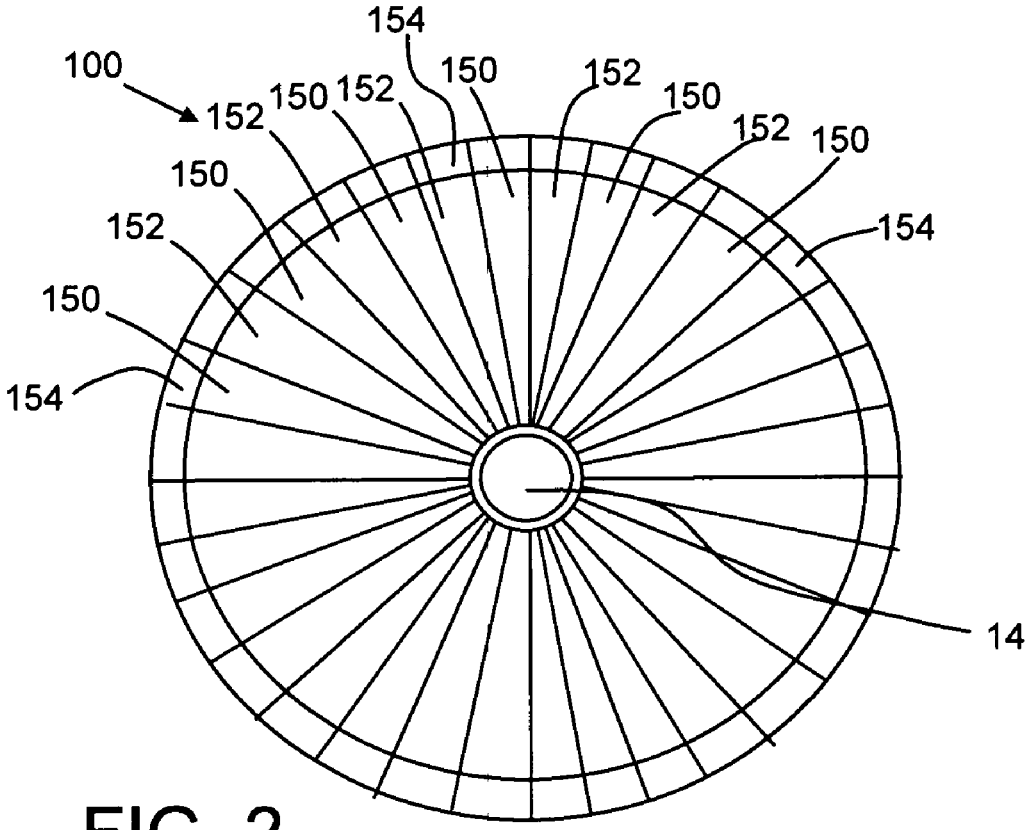
FIG. 2 shows a schematic front view of one embodiment of a stage as cross-sectioned through a rotating shaft of a steam turbine.
Figure 3:
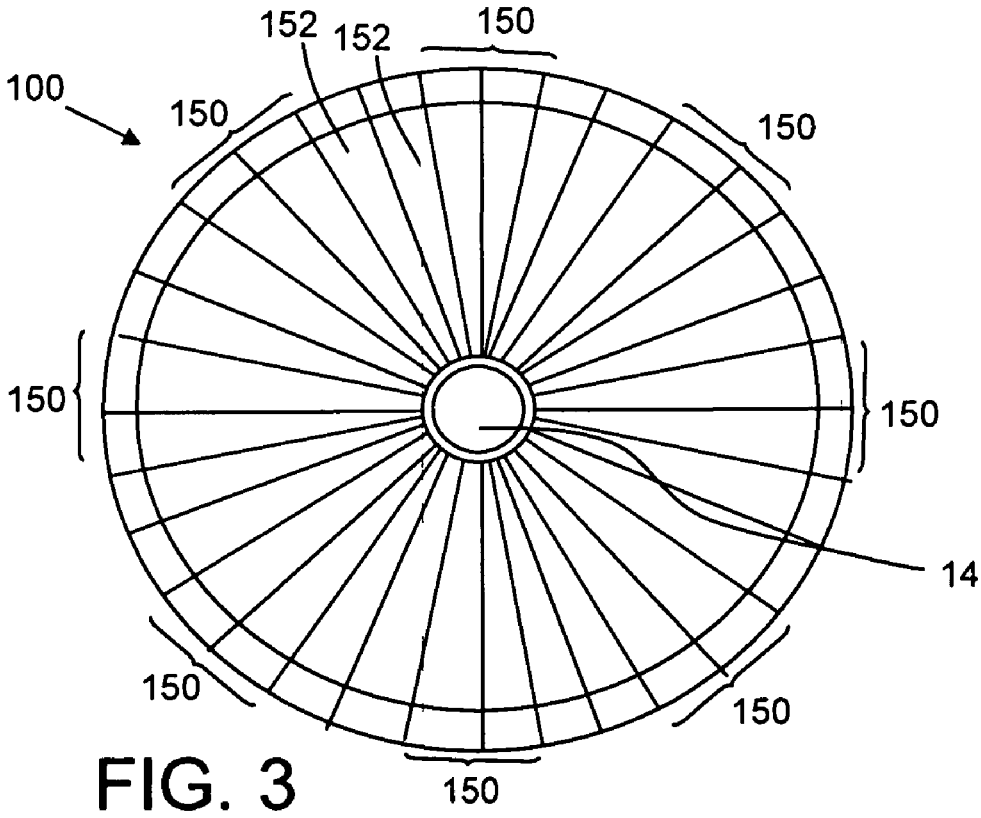
FIG. 3 shows a schematic front view of another embodiment of a stage as cross-sectioned through a rotating shaft of a steam turbine.
Figure 4:
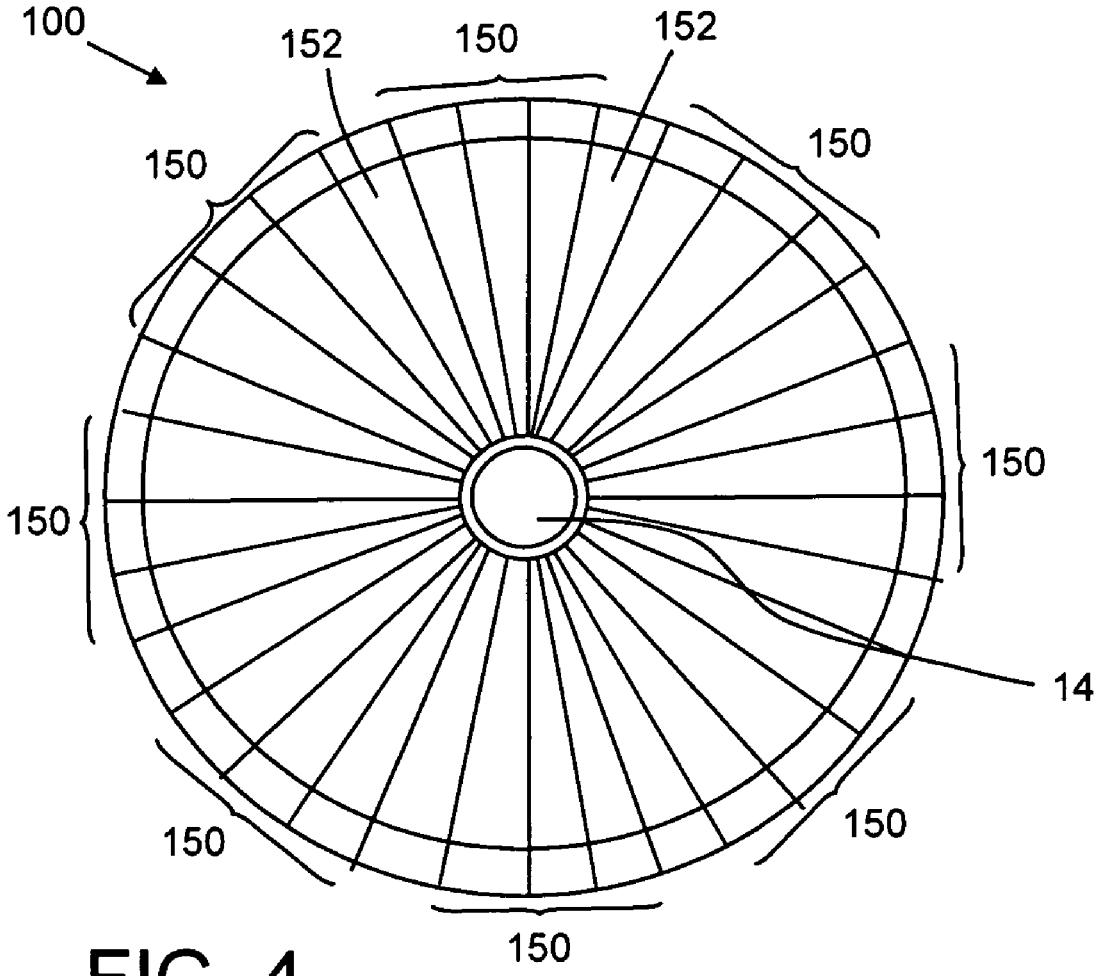
FIG. 4 shows a schematic front view of yet another embodiment of a stage as cross-sectioned through a rotating shaft of a steam turbine.

FIGS. 2-4 show schematic front views of embodiments of a stage 100 as cross-sectioned through rotating shaft 14 of steam turbine 10. Stage 100 includes a plurality of buckets 150, 152. Each bucket 150, 152 may include an integral cover 154 (FIG. 2 only), i.e., buckets 150, 152 constitute integral cover buckets (ICBs). In one embodiment, covers 154 on buckets 150, 152 may have different geometries. That is, the shape and/or dimensions of the covers may be different to accommodate the different coefficient of thermal expansion (CTE) characteristics of the particular material, while allowing for contact to be maintained.

In contrast to conventional stages, buckets include at least two buckets 150, 152 made of different materials. In one embodiment, the first material includes a stainless steel alloy (e.g., 403CB+, Crucible® 422) and the second material includes a nickel alloy (e.g., Inconel®). For example, at least two buckets may include a set of first buckets 150 made of a first material and a set of second buckets 152 made of a second material where the first material different than the second material. In the FIG. 2 embodiment, first stainless steel buckets 150 and second nickel alloy buckets 152 alternate every other bucket circumferentially about the stage. In FIGS. 3-4, set of first, stainless steel buckets 152 are positioned in subsets of at least two buckets equally circumferentially dispersed about the stage between the set of second, nickel alloy buckets 152. In FIG. 3, pairs of first buckets 150 are interspersed between pairs of second buckets 152. In FIG. 4, sets of three first buckets 150 are interspersed between single second buckets 152. Although particular arrangements have been illustrated, it is understood that a variety of different arrangements may be possible. For example, sets of first buckets 150 may include more or less buckets in sequence. Similarly, sets of second buckets 152 may include more or less buckets in sequence. The ultimate arrangement will depend on dynamic conditions in which stage 100 will be used.

The above-described invention allows for a lower cost ICB assembly on stages of a steam turbine rotor. In particular, conventional stages used to prevent creep use only buckets with expensive nickel alloy integral cover buckets or stainless steel alloy peened (i.e., separated) cover configurations. In contrast, the present invention implements a stage that has lower costs because of the use of less expensive stainless steel alloy buckets with ICBs. When assembled, the first, nickel alloy buckets 150 act as a stop block or support for the pre-twisting of the second stainless steel buckets 152, which acts to maintain contact during use despite the use of non-nickel alloy buckets. In addition to the above advantages, the present invention presents a better visual appearance versus a peened cover, giving the impression of a clean ICB.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A steam turbine comprising:

a stage including a plurality of buckets each having an integral cover, the plurality of buckets including a set of first buckets made of a first material and a set of second buckets made of a second material, wherein the first material includes a stainless steel alloy and the second material includes a nickel alloy.

2. The steam turbine of claim 1, wherein the first buckets and the second buckets alternate every other bucket circumferentially about the stage.

3. The steam turbine of claim 1, wherein the set of first buckets are positioned in subsets of at least two buckets equally circumferentially dispersed about the stage between the set of second buckets.

4. The steam turbine of claim 3, wherein the covers of the at least two buckets have different geometries.

5. The steam turbine of claim 4, wherein the different geometries are selected to maintain cover contact between the at least two buckets.

6. A stage of a plurality of buckets each having an integral cover for a steam turbine, the stage comprising:

a set of first buckets made of a first material and a set of second buckets made of a second material, wherein the first material includes a stainless steel alloy and the second material includes a nickel alloy.

7. The stage of claim 6, wherein the first buckets and the second buckets alternate every other bucket circumferentially about the stage.

8. The stage of claim 6, wherein the set of first buckets are positioned in subsets of at least two buckets equally circumferentially dispersed about the stage between the set of second buckets.

9. The stage of claim 8, wherein the covers of the at least two buckets have different geometries.

10. The stage of claim 9, wherein the different geometries are selected to maintain cover contact between the at least two buckets.

* * * * *